United States Patent [19]

Lynch et al.

[11] 4,071,688

[45] Jan. 31, 1978

[54] METHOD AND ARTICLE FOR PROTECTING A PRECIPITATOR DISCHARGE ELECTRODE

[75] Inventors: Jerome G. Lynch, Bridgeport; William A. Quigley, Greenwich, both of Conn.

[73] Assignee: UOP Inc., Des Plaines, Ill.

[21] Appl. No.: 715,273

[22] Filed: Aug. 18, 1976

[51] Int. Cl.[2] ..... B03C 3/40; H01B 17/58

[52] U.S. Cl. ..... 174/138 R; 55/146; 55/150; 174/156; 174/167

[58] Field of Search ..... 174/5 R, 111, 135, 136, 174/138 R, 138 F, 155, 156, 167; 55/146, 147, 148, 150, 155, 156, 157

[56] References Cited

U.S. PATENT DOCUMENTS

| | | | |
|---|---|---|---|
| 2,408,253 | 9/1946 | Diebold | 174/136 |

FOREIGN PATENT DOCUMENTS

| | | | |
|---|---|---|---|
| 667,027 | 11/1938 | Germany | 174/90 |
| 17,387 of | 1911 | United Kingdom | 174/135 |

*Primary Examiner*—Laramie E. Askin

*Attorney, Agent, or Firm*—James R. Hoatson, Jr.; Barry L. Clark; William H. Page, II

[57] ABSTRACT

Discharge electrodes in electrostatic precipitators are protected from erosion caused by power arcs in the area along their length which is closest to the ground electrode plates by a shroud of high temperature insulating plastic such as Teflon. The shroud is formed in two longitudinally slidable interlocking sections which completely surround and insulate the electrode wire but can be assembled to the wire without disturbing its ends.

7 Claims, 7 Drawing Figures

METHOD AND ARTICLE FOR PROTECTING A PRECIPITATOR DISCHARGE ELECTRODE

BACKGROUND OF THE INVENTION

This invention relates to electrostatic precipitators and particularly to a method of protecting the wire electrodes from erosion or "burn-off" near their lower ends where electrical sparking tends to occur.

In electrostatic precipitators of the type used to remove fly ash from the flue gas of a coal fired boiler, the discharge electrodes are, typically, 0.093–0.109 in. stainless steel wires which are vertically suspended from frame members. The wires are generally 25–40 feet long and hang freely between the grounded plate electrodes. The wires have weights attached to hook portions formed at their lower ends to keep them taut and prevent them from being blown closer to one electrode plate than the other by the force of the flue gas stream which moves horizontally between the plates.

Wire failures of the discharge electrodes can result from a number of different reasons, all of which are not operational. For instance, if a wire is installed kinked, or the alignment of the wires between the collecting plate is poor, the wires will erode as a result of successive power arcs to the same point on the wire. This point is usually that sector of the wire that passes nearest the grounded plate. Proper maintenance can usually revolve this situation. On the other hand, there are precipitator applications where the process itself is conducive to precipitator wire failure. These applications normally consist of low sulfur coal fired boilers with precipitators that operate at predominantly higher spark rates. On units of this sort, the higher resistive load occurs at the bottom of the unit where heavier dust concentrations exist. As a result of this and also the location of lower plate stiffeners, the electrical sparking that does occur will occur at this point. The continued succession of power arcs to the same point on the wire results in erosion or "burning off" of the wire at that point. A typical wire that has burned off as a result of this effect will have an end that comes to a needle point at a position on the wire that is opposite the lower plate stiffener.

On newer low sulfur applications, it is common practice to provide discharge electrodes with heavier metal cross sections at the top and bottom or just bottom, as the case may be, to accommodate the heavier sparking. The affect of the "shroud" as it is called, is to (1) provide a heavier wire construction at the more vulnerable locations in order to accommodate any electrical erosion that may occur and (2) the increased diameter of the wire as a result of the shroud will cause the corona concentrations to be much less than the remainder of the wire and thus discourage any electrical arcs from taking place.

Although precipitator vendors recognize the need for the shrouded wires on these newer applications and provide them on the original installation, there are many installations that were originally designed and operated on high sulfur fuel that were not provided with the shrouded wires. These installations have since converted to low sulfur fuel and are now experiencing wire failures. As a result of going to low sulfur firing, the aforementioned higher spark rates are resulting in excessive wire failures and inconveniences to the operators. In order to eliminate the nuisance and downtime resulting from wire failures, operators are forced into completely replacing all existing wires with the shrouded wires at a considerable expense to themselves. One alternative that has been tried in the past is installing metal clip-on shrouds to the existing wires. Vendors have had little success with this method in that if the metal shroud is not installed correctly, fly ash will gather between the shroud and the wire, isolating them electrically. When this occurs, the shroud takes on a different potential than the wire and current flow or arcing takes place. In this case, the shroud is the direct cause of the wire failure. For this reason, it is usually best that the existing wires be replaced with new shrouded wires that have been prepared at the factory. These have a very good success rate but pose considerable expense to the operator. Obviously, it would be desirable to be able to reduce the very considerable time and expense of replacing the discharge wires since a single precipitator can contain 10,000 or more wires.

SUMMARY

It is among the objects of the present invention to provide a method and article for modifying discharge electrode wires in the field to protect them from erosion caused by sparking. It is another object to provide a shroud member which can be easily attached to a wire intermediate its ends and yet will completely surround the wire.

The foregoing and other objects are attained by the method and article of the present invention wherein a discharge wire is protected by placing an insulating shroud means in close contact with it in the region adjacent its lower end and adjacent the stiffening rib portions of the adjacent grounded electrode plates which are closer to the wire than the main portion of the plates. The shroud comprises a pair of slidably interfitting, non-conductive, high temperature plastic member which can be placed against opposite sides of the wire at spaced locations along the length of the wire and can then be moved along the wire into tight locking engagement with each other so as to completely surround a short length of the wire. The shroud preferably rests on the top of the hook portion formed at the lower end of the wire which carries the weight. Since the shrouds are non-conductive, there is no particular criticality as to the tightness of contact between the shroud and wire since corona will be completely suppressed along the length of the shroud. Thus, the non-conductive shroud solves the biggest problem of the field mounted metal shrouds, namely, the fact that their conductive nature can cause them to burn the wire unless they make solid contact with the wire.

DESCRIPTION OF THE PREFERRED EMBODIMENT

Figure 2:
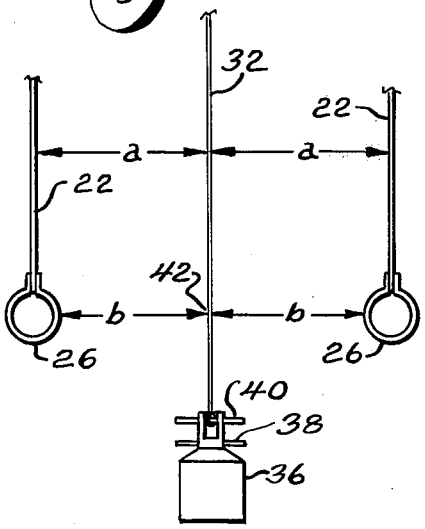
Fig. 2 (PRIOR ART)
FIG. 2 is an enlarged side view of a portion of FIG. 1 showing a discharge wire and a pair of electrode plates.
Figure 1:
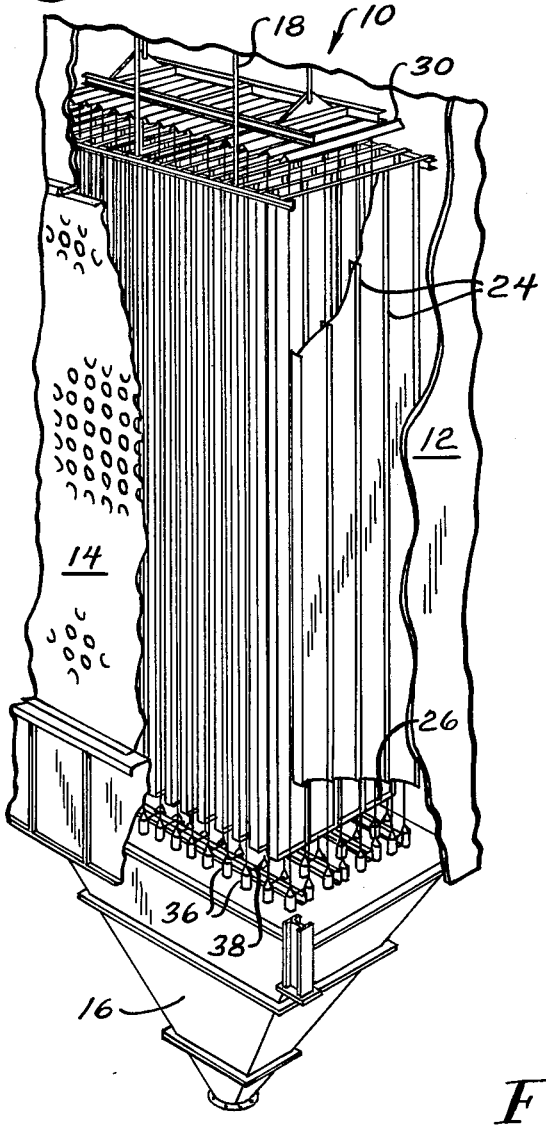
Fig. 1 (PRIOR ART)
FIG. 1 is a fragmentary perspective view of a prior art precipitator.

Referring to FIGS. 1 and 2 a precipitator 10 of the type known to the prior art is shown. The precipitator includes a housing 12, a perforated inlet diffusion plate 14 and a collection hopper 16 for collecting precipitated particles. Toward the top of the precipitator 10 a plate supporting frame 18 is mounted. The plate 18 has a plurality of grounding electrode plates 22 freely suspended from it. The plates 22 include vertical baffle portions 24 and lower stiffening portions 26. The baffle portions 24 extend partially in the gas flow path and serve to prevent the gases which pass through the diffusion plate 14 and between the plates 22 from wiping off particles which have been deposited onto the plates. Periodically, the frame 18 is rapped to cause the great majority of the particles attached to the plates 22 to break free and fall downwardly into the hopper 16. The baffles 24 shield the falling particles and help minimize the number of these particles which can be carried through the exit of the precipitator. Furthermore, the precipitator is usually comprised of several stages which are rapped at different times so that particles exiting one stage can be precipitated in following stages. The stiffening members 26 are preferably formed of curved metal such as shown in FIG. 2 and are tack welded or otherwise secured to the plates 22 to help keep the plates straight and free of warpage.

Also mounted at the top of the precipitator 10 is a wire hanging frame 30 from which are suspended a plurality of elongated discharge electrode wires 32 which have a hook portion 34 (see FIG. 4) formed at their lower end for the purpose of supporting a bottle-shaped weight member 36. The neck portions of the weight members 36 are preferably surrounded by a combination guide and retaining member 38 which is carried by an insulated portion of the housing (not shown). A cross pin 40 passing through the top of the weight members 36 serves as both an attachment means for engaging the hook portions 34 of the wires 32 and as a stop member which will engage the retaining member 38 to prevent the weight from falling into the hopper 16 should the wires 32 break or otherwise become unattached to the weights 36.

Figure 3:
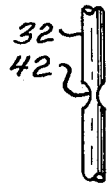
Fig. 3 (PRIOR ART)
FIG. 3 is an enlarged view of a portion of the discharge wire of FIG. 2.

Referring to FIG. 2, one can see that the distance *a* between the plates 22 and wire 32 is greater than the distance *b* between the metal stiffening members 26 and point 42 on the wire 32. Since arcing most easily takes place between a pair of members at their closest location to each other, it is obvious that any arcing that takes place in the FIG. 2 embodiment will take place at point 42. As previously discussed, arcing for a continuous period of time in a small area results in erosion so that the wire 32 will become thinner at point 42 as shown in FIG. 3 and eventually get so thin that the wire will snap and, without the downward force usually applied to it by the weight 36, be free to blow around and short circuit against the plates 22.

Figure 4:
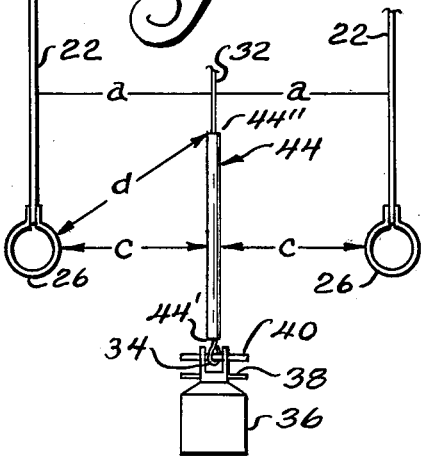
FIG. 4 is a side view similar to FIG. 2 but showing the use of our improved shroud over the discharge wire.

The arcing and erosion problems of FIG. 2 are solved by the insulating shroud 44 of the present invention which is mounted as shown in FIG. 4 with its lower end 44′ resting on the lower hook end portion 34 of the wire 32 and its upper end 44″ positioned a sufficient distance up on the wire 32 that the distance *d* between the stiffening portion 26 and the upper end of the shroud 44″ will be greater than the shortest distance *a* between plates 22 and wire 32 in the vicinity of the top of the shroud 44″. Although the shroud 44 is positioned at the distance C from the stiffening portion 26 which is shorter than the distance a, its insulating properties prevent arcing from taking place.

Figure 5:
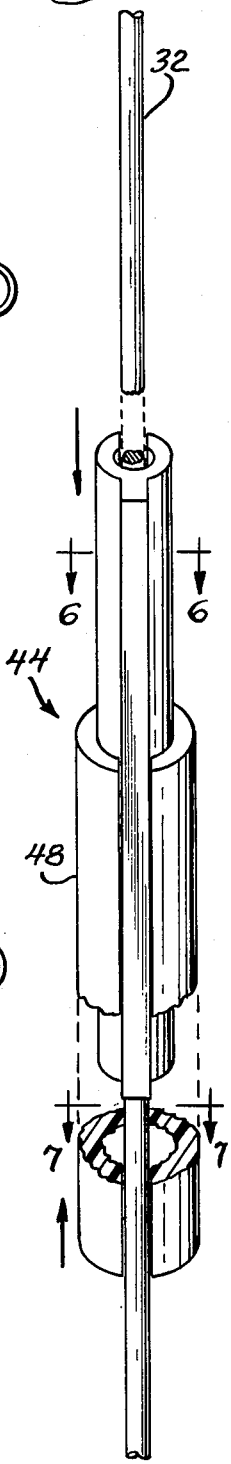
FIG. 5 is a partially broken away perspective view showing the two portions of the improved shroud being assembled to each other and to a discharge wire.
Figure 7:
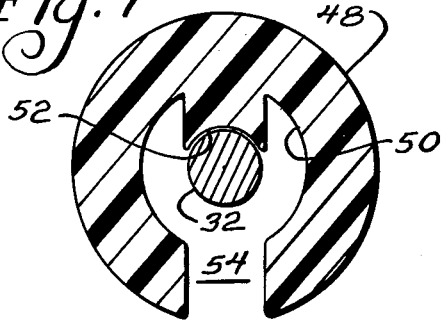
FIG. 7 is a sectional view taken on line 7—7 of FIG. 5.
Figure 6:
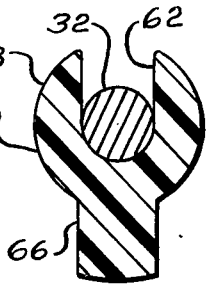
FIG. 6 is a sectional view taken on line 6—6 of FIG. 5.

The shroud 44 is manually assembled to the wire 32 as shown in FIG. 5 by moving the outer shroud member 48 transversely of its axis into contact with the wire. As can be seen in FIG. 7 the outer shroud member 48 has a curved inner wall surface 50 and a radially inwardly extending wire support surface 52. The outer surface of the member 48 is interrupted by a slot portion 54. The inner shroud member 58 shown in FIG. 6 is complementary to the outer member 48 and includes a curved outer wall portion 60 which slides in longitudinal engagement with inner surface 50. The member 58 has a slotted inner wall portion 62 which is adapted to be moved transversely into contact with the wire 32. A rib portion 66 engages and interlocks with the slot portion 4 of the outer member 48.

It will be readily understood that once the outer and inner members 48, 58 are axially moved into interlocking relationship with each other that the wire 32 will be completely surrounded and insulated from any arcing between the plates 22 and the wire 32. Preferably, the members 48, 58 which comprise the shroud are formed of an extruded Teflon (polytetrafluoroethylene) material capable of withstanding temperatures up to about 500° F.

We claim as our invention:

1. A method of protecting an installed electrostatic precipitator discharge electrode wire from power arc erosion adjacent its lower end comprising the step of placing a plastic insulating shroud completely around the wire along the length of the wire subject to power arc erosion.

2. The method of claim 1 wherein said shroud is formed of two slidably interlocking members which are first placed around said wire from opposing directions normal to the wire and at spaced locations along the wire and are then slid along the wire into overlying interlocking engagement with each other.

3. A shroud assembly for protecting an installed electrostatic precipitator discharge electrode wire from power arc erosion comprising a pair of first and second elongated plastic insulating members, each of said members including a longitudinal slot on one edge having a depth greater than the diameter of an electrode wire with which the member is adapted to be used, each of said members including a surface portion which is adapted to contact the surface of said wire and the second of said members having a portion having a transverse cross-sectional configuration which is complementary to the transverse cross-section of that portion of the slot in said first member which extends radially outwardly of said wire when installed thereon, each of said first and second members being adapted to be moved normally into contact with said wire at spaced locations along the length of said wire and then axially along said wire into overlying interlocking engagement with each other.

4. The shroud assembly of claim 3 wherein the sides of the longitudinal slot in the second member are defined by a bifurcated portion.

5. The shroud assembly of claim 3 wherein said members when assembled have an annular cross-section with an axial opening corresponding in size to an electrode wire with which the shroud is adapted to be used.

6. The shroud assembly of claim 3 wherein said plastic is a material capable of withstanding temperatures during use at least as high as 500° F.

7. The shroud assembly of claim 6 wherein said plastic material is polytetrafluoroethylene.

* * * * *